United States Patent [19]

Lowe

[11] Patent Number: 4,641,704

[45] Date of Patent: Feb. 10, 1987

[54] CONTINUOUS CASTING METHOD AND INGOT PRODUCED THEREBY

[75] Inventor: James H. C. Lowe, Moraga, Calif.

[73] Assignee: Degussa Electronics Inc., Morgan Hill, Calif.

[21] Appl. No.: 695,173

[22] Filed: Jan. 25, 1985

[51] Int. Cl.[4] ..... B22D 11/22

[52] U.S. Cl. ..... 164/474; 164/469; 164/488; 164/136; 164/494

[58] Field of Search ..... 164/469, 470, 471, 474, 164/492–497, 488, 122, 133, 136

[56] References Cited

U.S. PATENT DOCUMENTS

| | | | |
|---|---|---|---|
| 3,343,828 | 9/1967 | Hunt . | |
| 3,658,116 | 4/1972 | Hunt | 164/469 |
| 3,948,650 | 4/1976 | Flemings et al. . | |
| 3,951,651 | 4/1976 | Mehrabian et al. . | |
| 3,954,455 | 5/1976 | Flemings et al. . | |
| 4,089,680 | 5/1978 | Flemings et al. . | |
| 4,261,412 | 4/1981 | Soykan et al. . | |

OTHER PUBLICATIONS

H. Stephen, W. Dietrich, "Production of Superclean Material for Electronic and Power-Generator Application", Leybold-Heraeus GmbH, German Efficiency Show Japan 1984.

H. Stephan, H. Aichert, W. Dietrich, J. Heimerl, R. Schumann, "Some Results on Computer Controlled and Automated Production of Ingots From Refractory and Reactive Metals and Very Clean, Fine Grain Nickel-Base Superalloys", Leybold-Heraeus Technologies, Inc., Conference About Electron Beam Melting and Refining, State of the Art 1983, Reno, Nevada.

H. Stephan, H. Aichert, W. Dietrich, J. Heimerl, R. Schumann "Transformation of Process and Production Values From 60 and 100 kW EB-Power Melting Furnace into Pilot and Production Plants of 1200 kW and 800 kW EB-Power", Leybold-Heraeus Technologies, Inc., International Industrial Seminar on Pilot Plant Experiences-Melting and Processing Technology, Hilton Head, S.C., Oct. 10–12, 1983.

Merton C. Flemings "Solidification Processing", McGraw-Hill, 1974.

*Primary Examiner*—Kuang Y. Lin

*Attorney, Agent, or Firm*—Fitch, Even, Tabin & Flannery

[57] ABSTRACT

A method is described for continuously casting an ingot of a metal alloy of the type having a substantial liquidus-solidus temperature range so that the ingot will have a "smooth" surface free of hot-tears. A succession of substantially equal volume quantities of the molten alloy is poured into a continuous casting mold at a pressure of less than about $10^{-3}$ Torr. The quantity of each pour is sufficient to cover the entire cross section of the mold by flow under the influence of gravity and each quantity is allowed to substantially solidify between pours to form successive axial increments which make up the ingot. Each increment is allowed to cool for at least about 30 seconds between pours to form a sufficiently solid side-wall to prevent hot-tears. Heat is extracted between each successive pour from the annular region of the last poured increment adjacent the mold to permit the ingot being formed to be lowered in the mold without hot-tearing the ingot side-walls while maintaining the entire upper surface of the immediately preceding increment at a temperature at which metallurgical bonding with the last increment can occur. Before each successive pouring, the partially formed ingot is lowered in the mold a distance substantially equal to the increment thickness.

4 Claims, 2 Drawing Figures

CONTINUOUS CASTING METHOD AND INGOT PRODUCED THEREBY

This invention relates to metal casting and, more particularly, to a method of continuously casting an ingot of a metal alloy of the type having a substantial liquidus-solidus temperature range.

The continuous casting of ingots is a well-known and widely used technique in the metal processing industry Generally, the continuous casting process employs a continuous casting mold having a cooled outer wall and a movable bottom or plug. Molten metal is poured into the top of the mold and, as the metal solidifies in the mold, it is drawn downwardly by the plug while at the same time, additional molten metal is poured into the mold at the top. In casting alloys, segregation problems in the constituents of the alloy may be reduced or eliminated by cooling the ingot rapidly as it is drawn downwardly in the mold. To this end, in addition to the cooled walls of the mold, water sprays, baths of molten salts, or other similar cooling systems have been employed to increase solidification rate.

Where continuous casting is employed in connection with vacuum melting or processing of alloys, such cooling systems are not feasible where the casting is poured in vacuum. Accordingly, heat loss to the mold walls and, of course, downwardly through the solidified portion of the ingot, define the heat transfer parameters within which the system must be operated.

In continuous vacuum casting of metal alloys which have a significant range between the liquidus and the solidus temperatures, the need to rely for cooling solely upon heat transfer between the metal and the cooled mold into which it is transferred may substantially limit the production rate. If the metal adjacent to the wall of the mold has not solidified sufficiently when the ingot is moved downwardly, the frictional force between the mold wall and the ingot can create ruptures, known as hot-tears, in the side-wall of the ingot. For most purposes, hot-tears constitute an unacceptable side-wall condition for further processing.

To avoid hot-tears, the withdrawal rate of the ingot downwardly in the mold may be kept low enough to permit adequate solidification at the periphery, or to permit refilling of tears from the molten head on top of the ingot. With large diameter ingots, slow linear casting rates are often acceptable. However, for smaller diameter ingots, and in some cases for larger ones, the desired casting rate may create a hot-tear problem.

It is an object of this invention to provide an improved continuous casting process.

Another object of the invention is to provide an improved continuous casting process which substantially eliminates the danger of hot-tears in the side-wall of the ingot.

Another object of the invention is to provide an improved continuous casting process which is particularly suited to the continuous casting of alloys having a substantial liquidus-solidus temperature range.

Other objects of the invention will become apparent to those skilled in the art from the following description, taken in the connection with the accompanying drawings wherein:

Very generally, the method of the invention is directed to the continuous casting of an ingot of a metal alloy of the type having a substantial liquidus-solidus temperature range. The method produces ingots without significant surface defects such as hot-tears and cold-shuts. A succession of substantially equal volume quantities of the molten alloy is poured into a continuous casting mold at a pressure of less than about $10^{-3}$ Torr. Each quantity is sufficient to cover the entire cross-section of the mold by flow under the influence of gravity and is allowed to substantially solidify between pours to form successive axial increments which make up the ingot. The thickness of each increment is typically about two-thirds the length of the continuous casting mold, although the increment may be much smaller. Between each successive pour, heat is extracted from the annular region of the last formed increment adjacent the mold to permit the ingot being formed to be lowered subsequently without tearing the ingot side-walls while maintaining the entire upper surface of the immediately preceding increment at a temperature at which metallurgical bonding with the last formed increment can occur. Just prior to pouring the next increment, the partially formed ingot is lowered in the mold at a distance substantially equal to the increment thickness.

Figure 1:
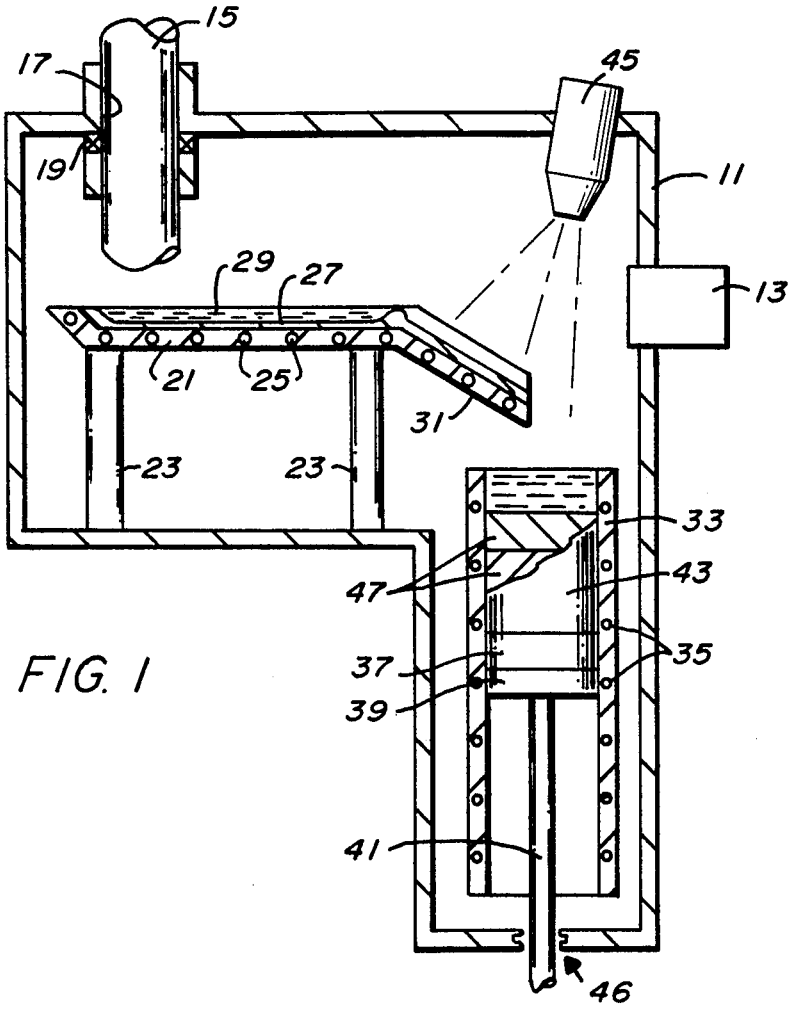
FIG. 1 is a schematic diagram of a high vacuum continuous casting system in which the method of the invention may be employed.

Referring now more particularly to FIG. 1, a schematic illustration of a system in which the invention may be employed is presented. A vacuum tight enclosure or furnace 11 is evacuated by a suitable vacuum pump or pumps 13 to a desired pressure, preferably of less than about $10^{-3}$ Torr. In the illustrated system, a feed-stock ingot 15 is fed into the furnace through an opening 17 in the furnace wall, sealed by a vacuum valve 19. A hearth 21 is supported by supports 23 inside the furnace and below the feed-stock 15. The hearth may be of any suitable design but is preferably of copper and is water-cooled through coolant passages 25 so that molten material contained within the hearth forms a skull 27 between the hearth and the molten pool 29 therein.

A launder 31 extends from the end of the hearth above a continuous casting mold 33. The continuous casting mold 33 has coolant passages 35 in the walls thereof for circulation of a suitable coolant to withdraw heat from the mold. A plug 37 of suitable material is provided inside the mold to form the lower terminus of the ingot to be cast. The plug is supported on a plate 39 which is moved by a rod 41 attached to a suitable mechanism or hydraulic system, not shown. As will be described, the ingot 43 is formed within the mold 33 above the plug 37 as a result of molten material being poured into the mold 33 from the launder 31. The ingot 43 is retracted into an extended volume of the vacuum enclosure. Rod 41 moves through a conventional atmosphere-to-vacuum seal 46.

For the purpose of melting the feed-stock 15, one or more electron beam guns 45 are provided. These guns may be the self accelerated type or may be the work accelerated type and are preferably capable of not only melting the lower end of the feed-stock, but sweeping across the surface of the molten pool 29 in the hearth, across the molten material running down the launder 31 and across the top of the ingot 43 in the mold 33. Suitable electron beam heating systems for accomplishing this purpose are well known in the art and will not be further described herein. Reference is made to U.S. Pat. No. 3,343,828 as one example of such heating systems. Reference is also made to Chapter 5, part 4 entitled "Electron Beam Melting" from the book *Electron Beam Technology,* by Schiller et al. for further examples of electron beam heating systems which may be employed in the method of the invention.

Energy from the electron beam gun 45 causes melting of the lower end of the feed-stock 15, which drips into the molten pool 29 on the hearth 21. During its residence time on the hearth, the molten metal is purified through the removal of volatile impurities as well as insoluble compounds, and is then passed into the mold 33 to form the continuously cast and therefore highly purified ingot.

In accordance with the present invention, the ingot 43 is cast by pouring into the mold 33 a succession of substantially equal volume quantities of the molten alloy in the pool 29 on the hearth 21. The quantity is selected to be sufficient to cover the entire cross-section of the mold 33 (i.e., the entire upper surface of the ingot 43 in the mold) by flow under the influence of gravity. This means that the quantity of molten metal must be sufficient to overcome the effects of surface tension and have sufficient fluidity so as to cover the entire area without freezing. After each pour, the quantity poured is allowed to substantially solidify around its outer periphery and thus form a sufficiently solid side-wall which does not tear when subsequently moved relative to the mold wall when the ingot 43 is retracted prior to the pouring of the next increment.

The interval between pours must be at least about 30 seconds. During the time interval between pours, the entire upper surface of the ingot is maintained at a temperature, by electron beam heating as necessary, sufficient to result in metallurgical bonding with the new pour. Typically, this temperature will be about 50° to 200° F. (30° to 120° C., approx.) below the solidus temperature. As a result, the successive increments 47 comprising the ingot 43 are metallurgically bonded to each other to form a metallurgically sound ingot.

Figure 2:
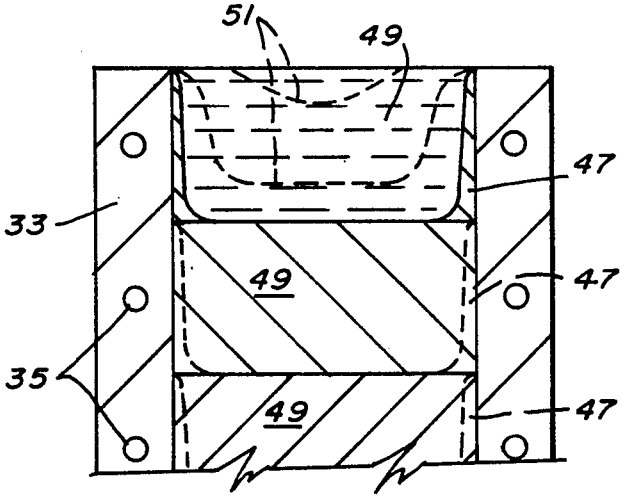
FIG. 2 is an enlarged cross-sectional view illustrating a portion of an ingot in a continuous casting mold produced in accordance with the invention.

Referring now to FIG. 2, an ingot made in accordance with the invention is shown schematically in the mold as it is formed. The successive axial increments 45 which may make up the ingot may vary in thickness from a minimum in the range 1/25 to ⅛ inch (1 to 3 min.) up to 6-inches (about 15 cm.) or more in axial height. Due to the solidifying characteristics as described above, the ingot has an outer periphery region 47 which comprises roughly 3 percent of the diameter of the ingot and wherein the grain orientation is in of a generally radially inward direction with the grains being generally elongated in such direction. The remainder of the ingot consists of grains which have no particularly consistent orientation; however, the ingot is sound and fully dense.

The following examples are provided in order to further illustrate the method of the invention. They are not intended in any way to limit the scope of the appended claims.

EXAMPLE 1

A vacuum-induction-melted, nickel-base alloy of nominal composition, cobalt 8%, chromium 13%, aluminum 3.5%, titanium 2.5%, columbium 3.5%, tungsten 3.5%, molydenum 3.5%, zirconium 0.05%, boron 0.012%, carbon 0.06%, and balance nickel was melted, refined and cast in the form of a 3-inch (approx. 7½ cm.) diameter ingot in an electron-beam, cold-hearth refining furnace. The metal was poured in 10-pound (approx. 4½ kg.) increments at time intervals of four minutes. The increments were about 5-inches (approx. 13 cm.) high. Pouring intervals were controlled by the use of a water-cooled copper finger that was positioned in the pouring spout between pours and that was raised to allow pouring to occur.

Electron-beam-heating at a level of 2 to 3 KW was applied to the top of the ingot during the casting operation. The ingot was withdrawn five-inches (13 cm.) approximately 10 seconds prior to the beginning of each pour. During this brief period, the beam was not impinging on the ingot top. The molten metal flow rate during the pouring period was 1000 to 1200 pounds (approx. 450–550 kg.) per hour, corresponding to a pouring time of about 30 seconds for each incremental pour. The average production rate was about 150 pounds (70 kg.) per hour.

EXAMPLE 2

A vacuum-induction-melted, nickel-base alloy of composition, nickel 52.5%, chromium 19.0%, columbium 5.2%, molydenum 3.0%, aluminum 0.5%, titanium 1.0%, carbon 0.05%, and balance iron was melted, refined and cast in the form of a 4½ inch (11.5 cm.) diameter ingot in an electron-beam, cold-hearth refining furnace. The metal was poured in 10-pound (4.5 kg.) increments, each about 2-inches (5 cm.) high, at time intervals of 3 minutes, for an average production rate of 200 pounds (90 kg.) per hour. The pouring intervals were controlled by the use of electron-beam heating applied to a pouring lip of the hearth to cause pouring to occur. The metal stopped flowing when the molten level in the hearth dropped to about ⅛ inch (3 mm.) above the pouring lip level. The electron-beam heat at the pouring lip was then removed, and the melting continued until the molten metal level in the hearth rose sufficiently to allow the next pour of 20 pounds (9 kg.) to occur when electron-beam heat was applied to the pouring lip. The time for each pour was about 30 seconds.

The round ingot was subsequently rolled successfully to 2½ inches (6.5 cm.) round-cornered square, both with and without prior heat treatment, and without surface conditioning for each of these conditions. Conventional practice is to cast a much larger ingot by vacuum-arc or electro-slag remelting, followed by extensive heat treatment, hot forging, surface conditioning and end-cropping operations to produce billets of cross-section comparable to that of the ingot prepared according to this example.

EXAMPLE 3

A vacuum-induction-melted alloy of nominal composition, nickel 43.7%, chromium 21.0%, columbium 22.0%, aluminum 13.0% and Ytrium 0.3% was melted, refined and cast in the form of a 2-inch (5 cm.) diameter ingot in an electron-beam, cold-hearth refining furnace. The metal was poured in 3-pound (1.3 kg.) increments at time intervals of 2 minutes, for a production rate of 90 pounds (40 kg.) per hour. The ingot was machined to obtain a smooth surface with removal of less than 0.050-inches (1.3 mm.) from the surface. This alloy is extremely brittle and cannot be cast conventionally in water-cooled molds without excessive surface tearing.

It may be seen, therefore, that the invention provides an improved method for continuously casting an ingot of a metal alloy of the type having a substantial liquidus-solidus temperature range. The existence of hot-tears in the ingot side-walls is substantially avoided.

Various modifications of the invention in addition to those shown and described herein will become apparent to those skilled in the art from the foregoing description and accompanying drawings. Such modifications are intended to fall within the scope of the appended claims.

What is claimed is:

1. A method of continuously casting an ingot of a metal alloy of the type having a substantial liquidus-solidus temperature range to produce an ingot with a surface substantially free of hot-tears, comprising:

pouring into a continuous casting mold at a pressure of less than about $10^{-3}$ Torr, a succession of substantially equal-volume quantities of the molten alloy, each quantity being sufficient to cover the entire cross-section of said mold by flow under the influence of gravity, each quantity being allowed to cool for a period of at least 30 seconds between pours by extracting heat from the last formed increment adjacent the mold substantially only via the mold walls to permit the ingot being formed to be lowered in the mold without tearing the ingot side-wall, maintaining by substantially continuous electron beam irradiation the entire upper surface of each last poured increment at a temperature at which metallurgical bonding with the next poured increment can occur, and before each successive pouring and after the cooling period, lowering the partially formed ingot in the mold a distance substantially equal to the increment thickness.

2. The method of claim 1, wherein the ingot is formed of an alloy having a liquidus-solidus temperature range between about 50° C. and 150° C.

3. The method of claim 2, wherein the alloy is a nickel or cobalt-base alloy containing at least about 40% nickel or cobalt, respectively, and between about 10% and 30% chromium.

4. The method of claim 1, wherein each increment is poured to a thickness of between about 3 mm. and 20 cm.

* * * * *